US005147259A

United States Patent [19]

Hutchins

[11] Patent Number: 5,147,259

[45] Date of Patent: Sep. 15, 1992

[54] ABDOMINAL MUSCLE EXERCISE MACHINE

[76] Inventor: Kenneth M. Hutchins, 350 Hidden Pines Cir., Casselberry, Fla. 32707

[21] Appl. No.: 598,131

[22] Filed: Oct. 16, 1990

[51] Int. Cl.[5] ..... A63B 21/00

[52] U.S. Cl. ..... 482/101; 482/135; 482/145

[58] Field of Search ..... 272/116, 117, 118, 125, 272/131, 134, 144, 145, DIG. 4; 128/28 R

[56] References Cited

U.S. PATENT DOCUMENTS

| | | | |
|---|---|---|---|
| 4,500,089 | 2/1985 | Jones | 272/118 X |
| 4,542,900 | 9/1985 | Ray | 272/134 |
| 4,600,189 | 7/1986 | Olschanski et al. | 272/118 |
| 4,632,393 | 12/1986 | Van Noord | 272/134 |
| 4,702,108 | 10/1987 | Amunsen et al. | 272/134 X |
| 4,799,671 | 1/1989 | Hoggan et al. | 272/118 |
| 4,848,740 | 7/1989 | Van Der Hoeuer | 272/134 |
| 4,858,919 | 8/1989 | Jones | 272/134 |
| 4,951,943 | 8/1990 | Farerholtz | 272/118 X |
| 5,050,872 | 9/1991 | Farerholtz | 272/118 |

*Primary Examiner*—Robert Bahr
*Attorney, Agent, or Firm*—Warren L. Franz

[57] ABSTRACT

An exercise machine for isolating and strengthening the abdominal muscles has a horizontally-movable plunger having a convex-shaped back contacting pad for linearly applying the force of a weight stack to resist back flexing of a seated user, and also has arm and leg immobilizing structure to arrest reactionary forces during such flexing, thereby minimizing hip flexion. The plunger is attached to a carriage mounted for horizontal movement on rails. A cable connection between the carriage and the weight stack includes a cam for varying resistance with changes in the degree of flexing.

18 Claims, 2 Drawing Sheets

ABDOMINAL MUSCLE EXERCISE MACHINE

This invention relates to an exercise machine for strengthening the abdominal muscles; and, in particular, to apparatus for linearly applying a resistance to oppose extension of the back during contraction of the abdominals, while minimizing accompanying hip flexion.

BACKGROUND OF THE INVENTION

The superficial abdominal muscle group (hereafter "abdominal muscles") comprises four distinct but overlapping muscular structures: the external of descending oblique muscles located on the sides and forepart of the abdomen; the internal of ascending oblique muscles located beneath the external obliques; the transversalis muscles located beneath and the abdominal rectus muscles which the internal obliques; extend down the whole length of the front of the abdomen. Most of these contribute to trunk flexion. All contribute to abdominal constriction. Two contribute to trunk rotation to the right or left.

The most straightforward and generally useful movement to address the entire abdominal musculature is trunk or torso flexion. Such flexion includes flexion of the thoracic, lumbar and sacral regions of the spine, as well as flexion of the pelvis. Abdominal contraction also results in chest depression and some shoulder depression.

Various calisthenic or freehand abdominal exercises have long been practiced for the purpose of strengthening the abdominal muscles. Though leg raises, trunk twists and various other movements have been used, the primary exercise mode has been the tradition situp. The situp is, however, only partially effective in addressing the ventral torso below the ribs as the torso is flexed—chest bent toward the thigh.

Situps and leg raises involve trunk flexion, but such flexion is usually only supportive and secondary to hip flexion, i.e., bending the thighs onto the chest. Hip flexion involves the hip flexor musculature: the sartorius, iliopsoas, and rectus femoris. The abdominals are involved to stabilize the pull of the hip flexors against the bones in the torso, but the major emphasis of such exercises is on the hip flexor group, not the abdominals.

The trunk curl is a freehand exercise developed to work the abdominals with maximum exclusion of the hip flexors. The trunk curl is described in books by Ellington Darden, Ph.D., Nautilus Sports/Medical Industries, Dallas, Tx. Though the trunk curl is useful for teaching proper isolation of the abdominals, it lacks a counterforce applied to the back which is sufficient to achieve a meaningful stretch.

The same exercises have been performed with the additional benefits (and disadvantages) of dumbbells and barbells. Along with this evolution came the Roman Chair and the Slant Board, each of which possessed a method to lock down the feet or legs as the torso was worked from various angles of declination. While such approaches were very popular and at least partially successful for isolating and working the abdominal structures, they had problems. They were as much hip flexion exercises as they were abdominal exercises.

The early development of Nautilus TM equipment utilizing adjustable weight stacks, force redirectional sprocket and chain systems, and cams for applying variable resistance forces discouraged the development of equipment for exercising the abdominal muscles in an isolated manner. It was thought that because the abdominals participate to some extent in all exercises, especially pullover and chinning movements, they would be corecipients of the benefits of such equipment. A special machinery for the abdominals arose, however, in response to customer demand.

About 1980, the first Nautilus TM "abdominal machine" was introduced. It was a rotary-movement machine that offered the potential for meaningful isolation of the abdominals, but was mostly used as a situp machine, i.e., a machine to assist hip flexion movement. Such unintended use obviated the potential for isolating the abdominals and, in some cases, was thought to lead to back problems. This so-called "crunch" version of the Nautilus TM abdominal machine was not effectively usable by weaker individuals because the movement arm was heavy and not counterbalanced.

A less ideal, but more generally usable rotary-movement Nautilus TM machine was introduced about 1982. It was more of a situp machine that worked the hip flexors, so was readily accepted and mastered by end users because of the common situp mentality. Other companies copied this approach.

In 1986–87, several abdominal machine prototypes with a moving axis were developed, though not commercially produced. The spine is comprised of not one joint, but many, all of which rotate simultaneously. However, there exists only one effective and collective axis of the torso at any instant, hence, instant axis. This instant axis moves in an anterior-posterior reciprocation as the spine is alternatively flexed and extended. Therefore, the thought behind the moving axis machine was that a movement axis that remained concentric with the body's instant axis might force the user to flex the spine rather than the hips and perform a true abdominal exercise, not a situp movement.

In 1989, a new Nautilus TM machine was introduced that included elbow pads, a rotary movement similar to a limited range pullover, and a moving axis. This machine was, however, designed to severely limit the movement range toward stretch (extension) where much of the effectiveness of abdominal exercise is felt and often desired by the user.

While conventional design approaches to abdominal muscle exercise machines have provided some potential for isolated torso flexion/extension to achieve desired abdominal involvement, the correct function was not imposed on the user. It was entirely possible to work the machine's mechanism with incorrect actions, such as situp/hip flexions, because the proper torso flexion/extension was not mandated.

SUMMARY OF THE INVENTION

It is an object of the present invention to provide an exercise machine for isolating and strengthening the abdominal muscles that requires the user to perform correct torso flexion/extension in order to operate the machine.

In one aspect of the invention, an exercise machine includes means, having a linearly movable member displaced when a user flexes his back, for applying a force to resist the flexion to thereby strengthen the abdominals, and means for restraining movement of the user's arms and legs to minimize the involvement of hip flexion during the back flexing.

In a preferred embodiment of the invention, described in greater detail below, the machine has a linearly movable member in the form of a push-rod or plunger that has a convex-shaped pad at a free end which is positioned to contact the middle or lower back of the user. The user's legs are restrained by a fixed member in the form of a nest of leg contacting pads that serve to maintain the position of the user's thighs. The machine also includes an arm restraining member in the form of a fixed brace to immobilize the arms. Means is provided to connect a weight-selectable weight stack to the plunger to provide resistance that varies in a controlled manner according to the degree to which the user's back is flexed.

To operate the machine, the user is required to push the middle or lower back into the padded end of the linear movement arm as reactionary forces are contained by the thigh and arm immobilizing members. In so doing, the chest is depressed and the thoracic spine, the lumbar spine, the sacrum, and the pelvis are flexed. To accommodate this flexion, some rotation occurs in the hip and shoulder joints. Because of the machine in accordance with the invention, however, the involved hip rotation that occurs during torso flexion is extension rather than flexion.

BRIEF DESCRIPTION OF THE DRAWINGS

Embodiments of the invention have been chosen for purposes of illustration and description, and are shown in the accompanying drawings, wherein.

Throughout the drawings, like elements are referred to by like numerals.

DETAILED DESCRIPTION OF PREFERRED EMBODIMENT

Figure 1:
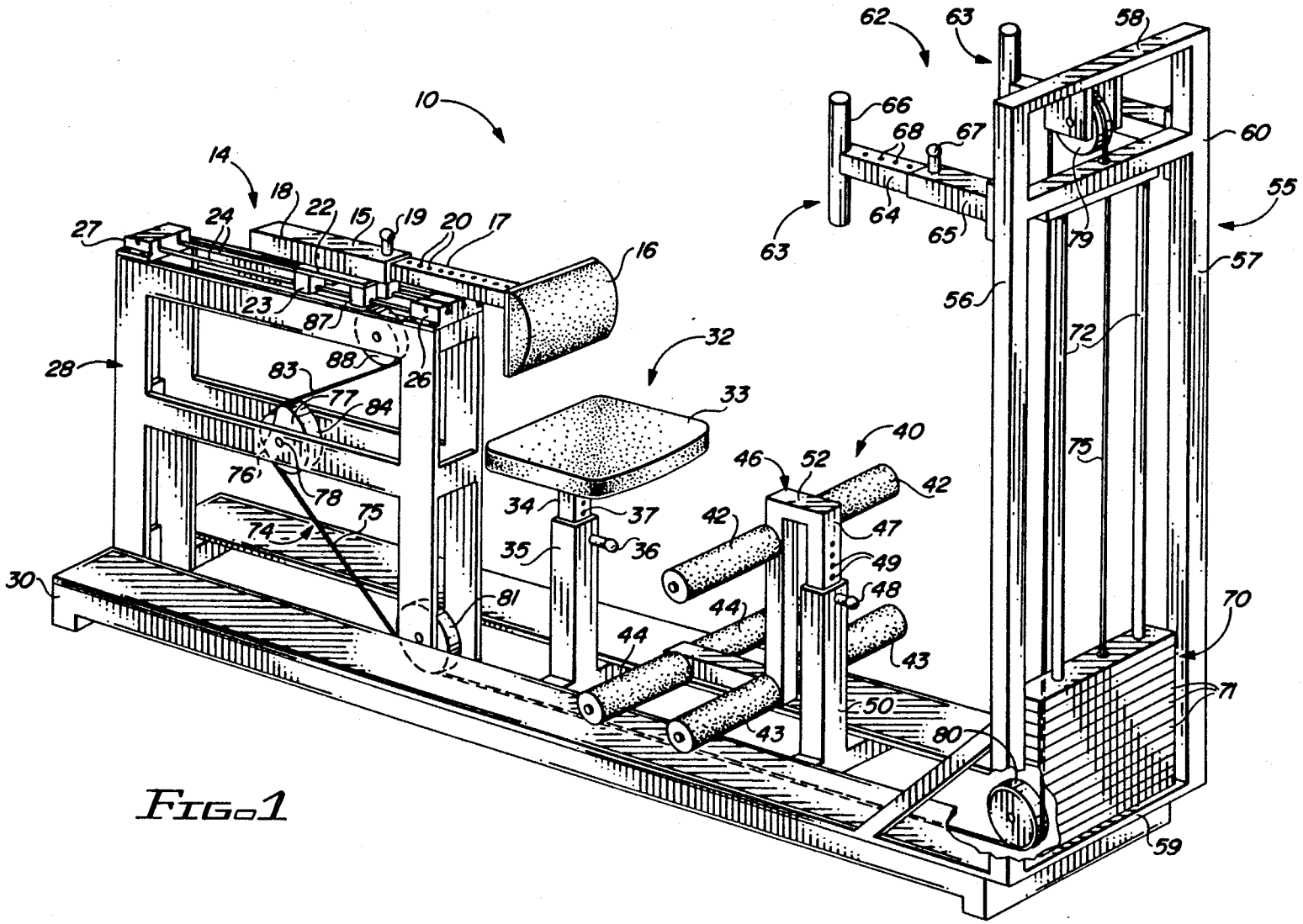
FIG. 1 is a perspective view of an abdominal muscle exercise machine constructed in accordance with the principles of the invention.

The principles of the invention are illustrated with reference to an abdominal exercise machine 10 shown in FIGS. 1–3 for linearly applying a resistance in a controlled variable way to the back of a user 12 during contraction and lengthening of the abdominal muscles. The fully contracted state of the abdominal muscles corresponds to the fully flexed position of the trunk, remindful of the raised back of a frightened cat depicted in Halloween decorations.

The apparatus 10 comprises a linear motion assembly 14 having a horizontally movable elongated push-rod or plunger 15, to a front free en of which is mounted a convex-shaped pad 16. The plunger 15 includes coaxial telescoping inner and outer tubular members 17, 18 and means, such as a pin 19 attached to tube 18 engageable in a selected one of a plurality of holes 20 of tube 17, for fixing the length of extension of the padded end 16 relative to the tube 18. The tube 18 is mounted on a carriage 22 having bearing pillow blocks 23 arranged to transport the carriage 22 and the tube 18 longitudinally along spaced parallel horizontal rails 24. The opposite ends of the rails 24 are captured within aligned apertures of opposing end supports 26, 27 mounted in elevated position atop a framework 28 fixed at the rear of a base 30. The assembly 14 may, for example, suitably be a double shaft, end supported linear motion system of the type commercially available from Thomson, Port Washington, N.Y.

A seat assembly 32, comprising a horizontally planar cushion 33 centrally supported in elevated position atop a vertical column 31, including coaxial inner and outer tubular members 34, 35, is attached to the base 30 ahead of the framework 28. A pin 36 on member 35 cooperates with holes 37 on member 34 to provide adjustment of the height of cushion 33 relative to the base 30 and, thus, relative to the padded end 16 of plunger 15. The horizontal spacing of the seat assembly 32 relative to the pad 16 is controlled by the placement of pin 19 relative to the holes 20 of plunger 15.

A leg nest assembly 40 is attached to base 30 in spaced relationship ahead of seat assembly 32. The assembly 40 includes a plurality of oppositely laterally extending pairs of cylindrical leg supports pads 42, 43, 44 supported on a rearwardly facing L-shaped portion 45 of a carrying bracket 46. The pads 42 and 43 are supported in vertically spaced positions above one another and the pads 43, 44 are supported in horizontally spaced positions ahead of one another on the portion 45. The bracket 46 also has a downwardly-extending upright portion 47 ahead of portion 45 which interconnects in coaxial telescoping relationship with a hollow upright tubular member 50. The portions 45, 47 are connected at respective upper ends by a longitudinally extending crosspiece 52. The lower end of member 50 is fixed to base 30, and a pin 48 on member 50 cooperates with holes 49 on portion 47 to adjust the elevation of the bracket 46 relative to the seat 33 and pad 16.

Extending up from base 30 at the front of machine 10 is an open rectangular header 55 comprising laterally spaced columns 56, 57 connected at upper and lower ends by lateral crosspieces 58, 59 and at an intermediate elevation by a lateral crosspiece 60. An arm bracing assembly 62, comprising left and right handles 63, extends horizontally rearwardly from the header 55. Each handle 63 includes coaxial telescoping inner and outer tubular members 64, 65. A vertical rod-like hand grip 66 is fixed proximate the rear of each member 64. Pins 67 on members 65 and holes 68 on members 64 are selectively interengageable to fix the horizontal spacing between the grips 66 and the seat assembly 32.

A conventional weight-selectable weight stack 70 is positioned in the gap between the columns 56, 57. The stack 70 comprises a plurality of weight elements 71 mounted for vertical movement on parallel laterally-spaced rails 72 whose opposite ends are respectively attached to the crosspieces 59, 60. A cable and pulley system 74 connects the weight stack 70 to the carriage 22 of the linear motion assembly 14. A first cable, chain or similar flexible lineal element 75 is fixed at one end to a selected number of weight elements 71 of stack 70 and at an opposite end to a point 76 on the perimeter of a cam 77 which is connected to a shaft 78 rotatably supported on the framework 28. Intermediate portions of the cable 75 are passed circumferentially around circular redirectional pulleys or sprockets 79, 80, 81 which are respectively rotatably mounted adjacent the crosspiece 58, crosspiece 59 and forward lower end of framework 28. A second cable, chain or similar flexible lineal member 83 has one end connected at a point 84 on the circumference of a pulley or sprocket 86 and another end connected to a point 87 at the underside of carriage 22. The pulley 86 is coaxially mounted for rotation on shaft 78 adjacently secured to cam 77. An intermediate portion of the cable 83 passes circumferentially around a redirectional pulley or sprocket 88 which is rotatably mounted at the forward upper end of framework 28.

Figure 2A:
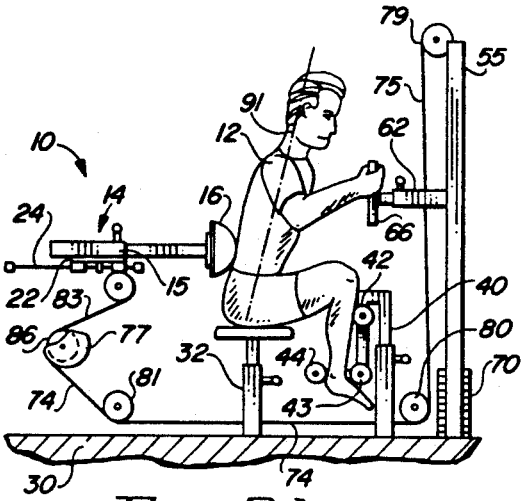
FIGS. 2A–2C are progressive schematic views helpful in understanding the operation of the apparatus of FIG. 1.
Figure 2B:
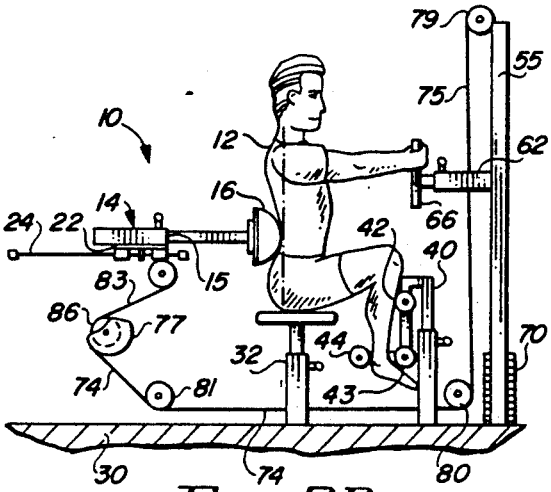
Figure 2C:
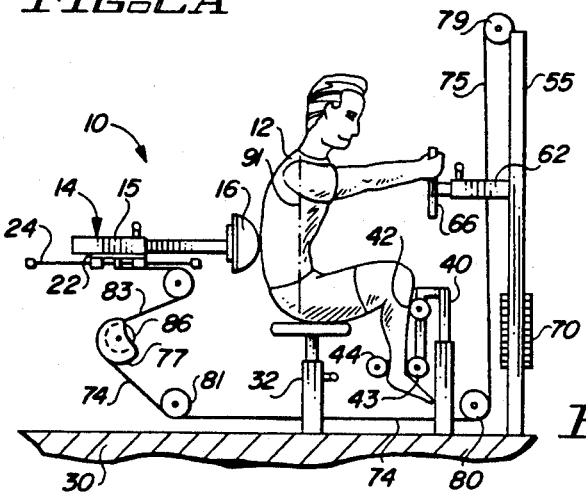

As shown with reference to FIGS. 2A–2C, the linear motion assembly 14 is positioned relative to the base 30 and, thus, the seat assembly 32 so that the padded end 16 of the piston 15 will contact the middle or lower back of the seated user 12. The leg nest assembly 40 is positioned so that each lower leg of the seated user 12 will be captured by the pads 42, 43, 44 to restrain movement of the thighs. The first pad 42 on each side is positioned to abut the anterior tibial tuberosity of each leg; the second and third pads 43, 44 abut the anterior and posterior aspects, respectively, of the lower shin area. The pads 42, 43, 44 serve to hold the knee in a roughly 90° angle of flexion. The arm bracing assembly 62 is positioned so that the grips 66 can be grasped by the hands of the user 12 to hold the arms outstretched. Cam 77 may be a cam of the type known for conventional exercise machines which use a cable fixed to a cam, redirectional pulleys and a weight stack to provide balanced variable resistance against movement of a padded member by a user. The general size and shape of cam 77; radii of the redirectional pulleys; and angles and distances between cam and pulley rotational axes can be determined using known techniques according to a strength curve developed for the abdominal muscular structure being exercised.

The operation of machine 10 is illustrated with reference to FIGS. 2A–2C. FIG. 2A shows the user in the machine entry position; FIG. 2B shows the user in the "loaded" or torso-extended/abdominal-muscle-stretched position; and FIG. 2C shows the user in the torso-flexed/abdominal-muscle-contracted position.

In operation, the height of column 31 of seat assembly 32 and height of L-shaped portion 45 of leg nest assembly 40 are adjusted so the user 12 (FIG. 2A) sits upright on cushion 33 with pad 16 contacting the user's back midway between the shoulders and the hips, thighs extending horizontally forward, and knees bent to approximately 90° flexion with the lower legs depending vertically. Each lower leg is rested in the corresponding three pads 42, 43, 44 of nest 40. Pad 42 abuts the anterior tibial tuberosity to supply indirect counterforce through the length of the femur to the resistance force of stack 70 applied through the plunger 15 (see FIG. 3). Pads 43, 44 abut the lower shin to hold the knee in its right angle flexion.

The arms of the user 12 are brought into outstretched positions (from the positions of FIG. 2A to those of FIG. 2B) with the hands abutting the grips 66 for bracing as in a locked-out position of a bench press or a stiff-arm. In anatomical terms, the shoulders are flexed anteriorly approximately 90° and the elbows are extended to anatomical zero (FIG. 2B). The arms are held horizontal with the heel of each hand abutted to the grips 66. The handles 63 and outstretched arms serve a parallel purpose to the first lower leg pads 42 and the femurs. Combined, they supply indirect counterforce to the gravitational force resistance of the stack 70 applied horizontally linearly against the back. There will, thus, exist upper and lower parallel counterforce vectors at the shoulders and hips directed equally and oppositely to the machine force vector, as shown by the force vectors in FIG. 3, as the user's back 90 and the pad 16 are moved from their solid line positions 90, 16 (corresponding to the abdominal-stretched view of FIG. 2B) to their dot-dot-dashed positions 90', 16' (corresponding to the abdominal contracted view of FIG. 2C).

Figure 3:
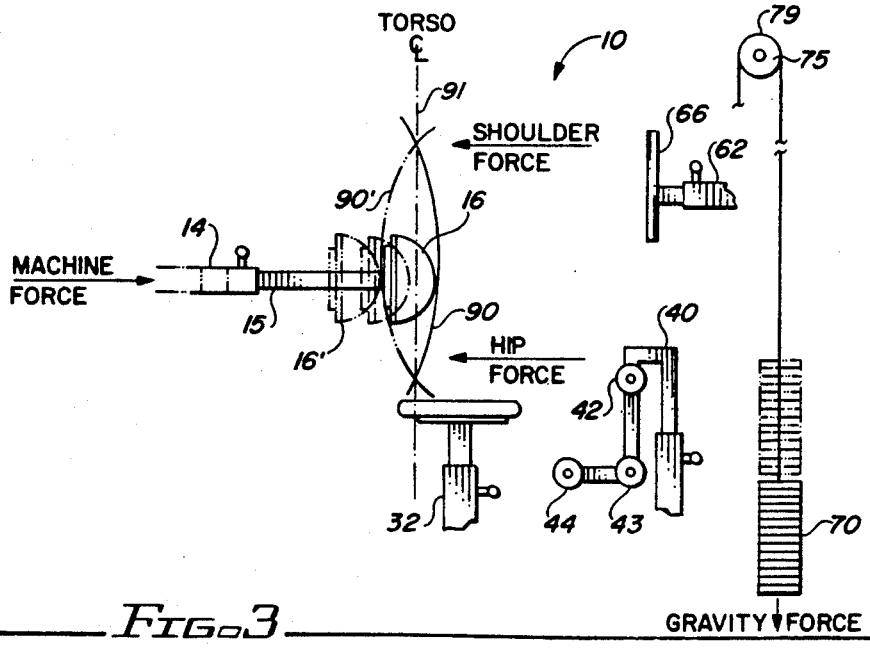
FIG. 3 is a diagram showing the forces acting on the user during the operation shown in FIGS. 2A–2C.

The force generated by the user during torso flexion (moving from the position of FIG. 2B to that of FIG. 2C) effects a linear posterior movement of the center of the back (viz. movement of center of back in movement from position 90 to position 90' in FIG. 3) which is resisted by the padded plunger 15. The padded end 16 is shown positioned to broadly abut the middle of the back, roughly halfway between the shoulders and hips. The seat 32 and leg nest 40 heights are adjustable, however, not only to facilitate consistent placement at the same back location for individuals of differing stature, but also to enable the location of application of the machine force (higher or lower on the back) to be varied for the same individual, if desired. The plunger pad 16 is the primary contact between the body and the machine's resistance drive mechanism. Although the shown drive mechanism is a cable and pulley arrangement for applying gravitational force on a weight stack in a controlled variable way, it will be appreciated that other fixed and variable resistance sources may also be used, including barbell-plate weight baskets, rubber cords, springs, and electromagnetic resistance engines.

To make effective and safe use of the machine 10, the user 12 should first determine his safe but fullest range of motion. As part of his preparations, after setting the seat height so that the pad 16 will roughly centrally contact his back, he selects a weight setting at stack 70 to a magnitude he will be unable to move. If such a setting is not available, provision may be made for temporarily anchoring the stack 70 or cable 75 to the base 30. The extension of the plunger member 17 relative to member 18 is then adjusted to a middle position by moving pin 19 to a middle one of the holes 20. The user 12 then sits on the seat 33 and places his legs in the nest 40 and the heels of his hands against the handles 63, lightly grasping the grips 66.

The user 12 is now seated as shown in FIG. 2A, with torso leaning slightly forward at the hips and waist due to the projection of the pad 16 into the user's back. In this position, a torso centerline 91 (represented by a straight line drawn from the shoulders to the hips) will be slanted forwardly, as shown.

From this initial position, the user then begins to slowly straighten his arms, carefully locking his elbows. By straightening his arms, the shoulders are pushed back, making the torso centerline 91 more vertical. As the user 12 straightens his arms, the piston pad 16 is driven into the user's back to extend the torso between the shoulder and hip joints, bringing the user 12 into the "loaded" position shown in FIG. 2B. How far the spine 90 is extended (see solid line position of spine 90 in FIG. 3) is voluntarily controlled by the user 12 within the bounds of discomfort experienced when the arms are straightened.

If the user 12 can completely straighten his arms without discomfort, he bends his arms slowly to unload his torso structure, and exits the machine. He then advances the plunger 15 moving the pin 19 backward one hole 20—increasing potential torso extension—and repeats the entire process. If user 12 cannot straighten his arms without discomfort, the process is repeated in the same way, but by retreating plunger 15 by one hole 20.

Once the user ascertains the first plunger extension for which he is unable to slowly and comfortably straighten his arms, he moves the pin 19 into the next hole 20 forward for which straightening can still be done comfortably, and records this plunger adjustment as his safe and complete range of motion setting for the exercise. Repeating the procedure in this manner, the user 12 determines what setting provides a maximum safe stretch/extension with maximum resistance to back movement by the weight stack 70. Once the setting for a particular user 12 is determined, machine 10 can then be used on a regular basis without the necessity for that user 12 to repeat the proper setting determination process.

During abdominal muscle strengthening usage, user 12 selects a weight of stack 70 permitting complete movement from a moderate stretch (torso extension FIG. 2B) to a complete contraction (torso flexion FIG. 2C). A moderate stretch is that stretch attained by arching the back against a machine force applied by a weight of stack 70 selected for routine exercises. This is considerably less than the magnitude of weight used for the preliminary range of motion (plunger adjustment) determination.

The header columns 56, 57 can be provided with grid lines (not shown) to enable the user 12 to visually judge the adequacy of the vertical stroke of the weight stack 70 in front of him due to movement of the plunger 15 during the exercise. It is preferable that the user arch his back slowly in accordance with the teachings of the Super Slow TM protocol originated by the inventor. Once the exercise set is complete, the user 12 unloads the torso by permitting his arms to bend back into the FIG. 2A position. He then exits the machine. If at any time the user 12 feels jeopardized during the exercise, he can simply unload by bending his arms. In this way, the user 12 has complete control over loading, unloading, comfortable range of motion, and the like.

The pad 16 is preferably convex-shaped, as shown, so that it can fit the concave contour of the lumbar area of the back during extreme stretch/extension. This places loading over a maximized surface area rather than a confined point or on just one vertebrae. As the torso is flexed, this contact surface area reduces as the body's contour becomes more convex. However, as torso flexion progresses, the back remains protected because resistance from the weight stack applied through the cam is decreasing and architectural arch support of the back is increasing.

Those skilled in the art to which the invention relates will appreciate that the particular configurations of the linear motion assembly 14, seat assembly 32, leg nest assembly 40 and header 55, arm bracing assembly 62 and cable and pulley system 74 can be varied, and that various other substitutions and modifications can be made to the described embodiments without departing from the spirit and scope of the invention as described by the claims below.

What is claimed is:

1. An exercise machine for isolating and strengthening abdominal muscles of a user, said machine comprising:

a base having a front and a rear;

a seat mounted on said base intermediate said front and rear;

means mounted on said base, ahead of said seat, for restraining leg movement of the user seated on said seat;

an elongated plunger having a free end dimensioned configured and adapted for contacting the seated user;

means mounting said plunger on said base behind said seat, for horizontal movement of said plunger relative to said base rearwardly away from said seat in response to skeletal movement of the seated user applied to said free end;

a weight; and means mounted on said base connecting said weight to said plunger for causing said weight to move vertically in response to said horizontal movement rearwardly away from said seat, so that said weight applies a force directed forwardly toward said seat on said plunger during said plunger horizontal movement, to resist said skeletal movement by the user.

2. A machine as in claim 1, further comprising means mounted on said base for immobilizing the arms of the seated user, to maintain the position of a torso centerline of the user during said flexing.

3. A machine as in claim 1, wherein said free end of said elongated plunger comprise a pad having a convex-shaped surface facing said seat.

4. A machine as in claim 1, wherein said force applying means further comprises means for causing said weight to move vertically upward in response to said horizontal movement of said plunger away from said seat, so that gravitational force exerted vertically on said weight is translated into force applied horizontally to the user to resist said skeletal movement.

5. A machine as in claim 4, wherein said force applying means further comprises at least one rotary member, and at least one flexible lineal element connecting said weight through said rotary member to said plunger.

6. A machine as in claim 5, wherein said force applying means further comprises a shaft mounted for rotation on said base, a cam mounted on said shaft, a circular rotary member mounted on said shaft, a first flexible lineal element connecting said weight to one of said cam and rotary member, and a second flexible lineal element connecting the other of said cam and rotary member to said plunger.

7. A machine as in claim 1, wherein said leg movement restraining means comprises a nest of pads positioned to restrain the thighs of the seated user, with the user's knees bent in a 90° flexion position.

8. A machine as in claim 7, wherein said nest comprises pads respectively located to abut the anterior tibial tuberosity and the anterior and posterior aspects of the lower shin area of each leg.

9. A machine as in claim 1, further comprising means for selectively adjusting vertical and horizontal spacing between said seat and said plunger mounting means.

10. An exercise machine for isolating and strengthening muscles of a user, comprising:

a base having a front and a rear;

a framework attached to said base at said rear;

a seat attached to said base intermediate said front and said rear and ahead of said framework;

means, attached to said base intermediate said front and rear and ahead of said seat, for restraining leg movements of said user seated on said seat;

a header attached to said base at said front;

an elongated plunger having a free end dimensioned, configured and adapted for contacting said seated user;

means mounting said plunger on said framework, for horizontal movement of said plunger relative to said framework in response to skeletal movement of said seated user applied to said free end;

a weight stack;

means mounting said weight stack on said header for vertical movement of said weight stack relative to said header; and means connecting said weight stack to said plunger for causing said weight stack to move vertically in response to horizontal movement of said plunger, so that said weight stack applies a force on said plunger to resist said skeletal movement.

11. A machine as in claim 10, further comprising means attached to said header against which arms of the seated user can be braced for restraining arm movements to arrest reactionary forces to said arms caused by said skeletal movement.

12. A machine as in claim 11, wherein said arm movement restraining means comprises hand grips mounted on said header and facing said seat.

13. A machine as in claim 11, wherein said plunger free end comprises a pad having a convex-shaped surface facing said seat.

14. A machine as in claim 10 wherein said connecting means comprises at least one rotary pulley, a rotary cam, and at least one flexible lineal element connecting said weight stack to said plunger through said pulley and said cam, so that said force is applied on said plunger in a varying way in accordance with the shape of said cam.

15. A machine as in claim 10, wherein said means mounting said plunger on said framework comprises a pair of spaced horizontal rails attached to said framework; a carriage attached to said plunger; and bearing means mounting said carriage for horizontal movement along said rails.

16. A machine as in claim 10, wherein said leg movement restraining means comprises pads respectively located to abut the anterior tibial tuberosity and the anterior and posterior aspects of the lower shins are of each leg.

17. A machine as in claim 10, wherein said plunger comprises coaxial telescoping inner and outer tubular members; an means selectively engageable between said tubular members for fixing the relative positions of said tubular members.

18. An exercise machine for isolating and strengthening muscles of a user, comprising:

a base having a front an a rear;

a framework attached to said base at said rear;

a sear attached to said base intermediate said front and said rear and ahead of said framework;

means, attached to said base intermediate said front and rear and ahead of said seat, for restraining leg movements of said user seated on said seat;

a header attached to said base at said front;

means attached to said header against which arms of the seated user can be braced for restraining arm movements of said user seated on said seat;

an elongated plunger having a free end dimensioned, configured and adapted for contacting said seated user; said free end comprising a pad having a convex-shaped surface facing said seat;

means mounting said plunger on said framework, for horizontal movement of said plunger relative to said framework in response to skeletal movement of said seated user applied to said free end;

a weight stack;

means mounting said weight stack on said header for vertical movement of said weight stack relative to said header; and means connecting said weight stack to said plunger for causing said weight stack to move vertically in response to horizontal movement of said plunger, so that said weight stack applies a force on said plunger to resist said skeletal movement;

said connecting means comprising at least one rotary pulley, a rotary cam, and at least one flexible lineal element connecting said weight stack to said plunger through said pulley and said cam, so that said force is applied on said plunger in a varying way in accordance with the shape of said cam.

* * * * *